US012049760B2

(12) United States Patent
Draheim

(10) Patent No.: US 12,049,760 B2
(45) Date of Patent: Jul. 30, 2024

(54) STEEL INSTALLATION COMPONENT FOR BUILDINGS FOR REPLACING A PREDETERMINED REGION OF A REINFORCED CONCRETE COMPONENT PROVIDED FOR LOAD-BEARING

(71) Applicant: Christof Draheim, Raeren (BE)

(72) Inventor: Christof Draheim, Raeren (BE)

( * ) Notice: Subject to any disclaimer, the term of this patent is extended or adjusted under 35 U.S.C. 154(b) by 180 days.

(21) Appl. No.: 17/630,329

(22) PCT Filed: Aug. 8, 2019

(86) PCT No.: PCT/DE2019/000214
§ 371 (c)(1),
(2) Date: Jan. 26, 2022

(87) PCT Pub. No.: WO2021/023324
PCT Pub. Date: Feb. 11, 2021

(65) Prior Publication Data
US 2022/0251839 A1 Aug. 11, 2022

(51) Int. Cl.
*E04C 3/293* (2006.01)
*E04C 3/29* (2006.01)

(52) U.S. Cl.
CPC ..... *E04C 3/293* (2013.01); *E04C 3/291* (2013.01)

(58) Field of Classification Search
CPC . E04C 3/08; E04C 3/291; E04C 3/293; E04C 3/294; E04C 2003/046
See application file for complete search history.

(56) References Cited

U.S. PATENT DOCUMENTS 2,152,189 A * 3/1939 Henderson ..... E04C 3/08 52/645
4,115,971 A * 9/1978 Varga ..... E04C 3/294 52/250
4,196,558 A * 4/1980 Jungbluth ..... E04C 3/293 52/340
6,158,189 A * 12/2000 Lau ..... E04C 3/145 52/693
7,293,394 B2 * 11/2007 Davis ..... E04C 3/18 52/650.1
2003/0115815 A1 * 6/2003 Azizinamini ..... E01D 19/125 404/71
2004/0200180 A1 10/2004 Davis
2008/0282644 A1 * 11/2008 Hong ..... E04C 3/293 52/847
2010/0132283 A1 * 6/2010 Platt ..... E04C 3/291 52/223.6

(Continued)

FOREIGN PATENT DOCUMENTS

CA 2302114 A1 * 9/2001 ..... E04C 3/08
DE 19860340 C2 3/2003

(Continued)

*Primary Examiner* — Christine T Cajilig
(74) *Attorney, Agent, or Firm* — Smartpat PLC

(57) ABSTRACT

Steel installation parts can replace predetermined regions of reinforced concrete components provided for receiving loads, in particular reinforced concrete beams. The steel installation parts can be arranged in a less dense construction without losing bearing capacity, in order to create space for technical installation elements such as lines, cables and channels.

17 Claims, 7 Drawing Sheets

(56) References Cited

U.S. PATENT DOCUMENTS

| | | | | |
|---|---|---|---|---|
| 2011/0265422 | A1* | 11/2011 | Kim | E04C 3/291<br>29/897.35 |
| 2014/0059974 | A1* | 3/2014 | Polk, Jr. | E04C 3/28<br>264/279 |
| 2020/0165824 | A1* | 5/2020 | Kim | E04C 3/06 |
| 2021/0017765 | A1* | 1/2021 | Strickland | E04C 3/294 |

FOREIGN PATENT DOCUMENTS

| | | | | |
|---|---|---|---|---|
| FR | 2537631 | A1 * | 6/1984 | |
| WO | 9214007 | A1 | 8/1992 | |
| WO | WO-2007100226 | A1 * | 9/2007 | E04B 5/29 |

* cited by examiner

STEEL INSTALLATION COMPONENT FOR BUILDINGS FOR REPLACING A PREDETERMINED REGION OF A REINFORCED CONCRETE COMPONENT PROVIDED FOR LOAD-BEARING

TECHNICAL FIELD

The present invention relates to steel installation components which can replace predetermined regions of reinforced concrete components provided for load-bearing, in particular of reinforced concrete beams, and which without loss of load-bearing capacity can be structurally configured less dense in order to create space for technical installation elements such as pipes, cables and ducts.

BACKGROUND

The objective of the general prior art is not having to arrange technical installation elements below a support structure but within the construction plane with the same floor height, the room height of a building for the technical installation or, with the same room height, not having to increase the floor height. Load-bearing webs have to be provided with openings for this purpose, through which the installation elements can be passed. The load capacity of webs however is diminished by the introduction of openings situated too closely to one another. For this reason, openings have to be spaced apart from one another so far that the load-bearing capacity defined for the building concerned is not undershot. Here, based on pure double T-steel girders the basic rule defined for example in the Directive 015 (7/90) of the German Committee for Steel Construction (DASt) that without stiffener formed in a particularly solid and flexurally rigid manner between adjacent openings the distance between these has to amount to one and a half to two times the opening heights so as not having to configure the webs opened in such a manner larger and thereby thwart the objective of having to change neither the room height nor the floor height. The same basic rule applies to the distances of the openings to the girder ends.

Even the disclosure publication DE 198 60 340 A1 deals with the problem of the high installation density which is to be made possible within the construction plane. There, a compound girder for buildings with a web for absorbing transverse forces and with web openings for passing through installation elements is proposed, wherein the web openings are formed in a predetermined region of the girder in which, based on the support assembly, comparatively low transverse forces are active. With uniformly loaded single-span girders, such a region is regularly arranged centrally within the support assembly since the transverse forces within a girder diminish from the ends of the same towards the centre while the loading by the global moment is most active in the centre. In the case of multi-span girders, in particular in the case of such having different spans or uneven loading, other conditions can prevail, wherein suitable regions with relatively low transverse forces can also be regularly identified there.

The compound girder proposed in DE 198 60 340 A1 has the disadvantage that the predetermined region, in which relatively low transverse forces are active, is bordered by regions of the compound girder in which greater transverse forces are active. Typically, such a compound girder runs over the entire region to be underpinned. Accordingly, the entire compound girder, i.e. both the regions exposed to high transverse forces and also the region provided with web openings are produced from steel, wherein above the web openings a compression flange formed in one piece runs through over the entire girder length with the disadvantage of increased amounts of steel to be installed and accordingly higher costs.

SUMMARY

An object of the present disclosure is to provide the function of a compound girder while significantly reducing the steel content to be installed at the same time. The object is solved by means of a steel installation component and support construct as disclosed herein.

Proposed is a steel installation component for buildings for replacing predetermined regions of reinforced concrete components provided for load-bearing, in particular of reinforced concrete beams, which comprises a recess support comprising two connecting faces spaced apart from one another in the longitudinal direction each with a top, bottom, front and back side distinct from the connecting faces and one or more support openings of the recess support leading from the front to the back side provided for passing through the installation elements, whose distance from the respectively adjacent connecting face is shorter than their respective height between top and bottom sides. For example, the connecting faces based on a beam-like recess support are accordingly arranged on the front sides of such a beam while the ceiling to be underpinned is indirectly or directly supported on the top side. Generally, the respective sides are embodied flat. However they can also comprise curves, indentations or bulges. For example, the cross-section of the recess support could also be circular in special cases, when the mentioned sides would then be the corresponding circular arcs. The connecting faces of the recess support must not be equated to the ends determining the length of the steel installation component. The term connecting face rather refers to those faces of the recess support that are provided for delimiting the length of the concrete-free region of the support construct of reinforced concrete component and steel installation component, in that the concrete of the reinforced steel component is brought up as far as to these faces in the longitudinal direction of the recess support. When different such faces are present on the recess support, for example on the front sides of the same, the largest of these is initially considered as connecting face, in the case of the same size the face located nearer to the support opening. Nevertheless, connecting means as parts of the steel installation component projecting in the longitudinal direction over these faces or their planes or are arranged on these can be present, which for connecting purposes are covered by concrete. The distance between a support opening and an adjacent connecting face is defined for each of the connecting faces as the shortest distance between the respective connecting face and the nearest situated support opening, whose height is determined as its greatest extent between the top and bottom sides of the recess support parallel to the shortest connecting distance between the top and bottom sides of the same.

Advantageously, the objective of the saving of steel as girder material by means of the proposed steel installation component can be more easily achieved in that at least one support opening on its edge situated towards the lower side is delimited by one of the wide sides of a steel strip. Here, the steel strip, as the word part "strip" already suggests, has a cross-section that is wider than high so that accordingly it is possible to distinguish between wide sides, which extend along the width of the cross-section in the longitudinal direction of the steel strip, and narrow sides, which analogously extend along the height of the cross-section. In the following, the term "wide side" is also used for other components or elements and because of this analogously also points out that the cross-section of the same is wider than high. Preferably, the steel installation component is positioned so that the steel strip with positive moment acts as tension strip. However, a positioning, in which the steel strip, with at the most a comparatively small negative moment, assumes the function of a compression flange is also possible.

Depending on the installation density it can be advantageous to form the recess support of the steel installation component not only with one but with more than one support opening, wherein the distance between support openings adjacent to one another is shorter than the height of the respectively higher support opening. Generally, all support openings would have the same height.

Because of the provided arrangement of the steel installation component in a region, in which relatively low transverse forces are active, a support opening can be advantageously subdivided into separate portions by one or more braces running between the top and the lower sides, whose extent in the longitudinal direction of the recess support is shorter than the height of the support opening concerned. In practice, steel plates as braces whose wide sides are arranged orthogonally to the longitudinal orientation of the recess support will prove themselves here.

For the predominant number of the installation positions of the steel installation component it is advantageous or even required for structural reasons that the steel installation component has a profile provided for being covered with concrete for passing on the transverse force on the top side of the recess support. Preferably, such a profile is formed beam-shaped, as T-profile or as double T-profile and arranged parallel to the longitudinal orientation of the recess support. Furthermore, it can be advantageous when the recess support comprises a bearing plate to which belongs the top side of the recess carrier, which projects from under the supported profile and is intended for supporting the building (A), for example a floor ceiling, on the regions not covered by the profile.

Preferably, the profile for the passing on of the transverse forces comprises holes which are provided for the penetration with reinforcement bars transversely to the longitudinal orientation of the recess support. When covering such a profile with concrete, the concrete is brought up as far as to the top side of the recess support or up to the bearing plate. For a fixed anchorage of the steel installation component it is advantageous when bolts, preferentially shear studs, project parallel to the shortest connecting distance between top and bottom sides of the recess support, which are likewise provided for being covered with concrete.

A preferred embodiment of the steel installation component comprises on one or both sides an extension of the recess support on the lower side in the longitudinal direction. Advantageously, such an extension in each case is configured as continuation of the steel strip beyond the plane of the respective connecting face. Preferably it is provided here that the concrete is brought up both as far as to the front side of the recess support and also as far as to the front side of the continuation of the steel strip. The front side of the recess support in this case is considered as connecting face since it is larger than the front side of the continuation of the steel strip.

Advantageously, the steel installation component comprises a shear brace provided for being covered with concrete on at least one connecting face, whose wide sides are oriented parallel to the longitudinal direction of the recess support and to the shortest connecting distance between the top and lower sides of the same. Here, the anchorage of the shear brace in concrete can be advantageously reinforced in that it is formed as shear plate with transversely projecting bolts arranged on one or both sides, preferentially with welded-on shear studs. An adequate and material-saving shear brace is obtained by a configuration as a shear key, which in contrast with a shear plate typically run from the plane of the top side as far as to the plane of the lower side of the recess support, is run only over a part section between these two planes and instead is formed more solidly.

For the shear resistance of the steel installation component it is advantageous when the profile and the shear brace are rigidly connected to one another, for example by welding. Preferably, the components connected in such a manner include the recess support, with the exception of the lower side, in a frame-like manner.

Furthermore, the connection of reinforced concrete to the connecting faces can be advantageously effected in that on the connecting faces, parallel to the longitudinal orientation of the recess support, reinforcement portions are arranged for connecting the steel reinforcement of the reinforced concrete component, for example by means of a bolted connection or overlap joint.

Bolts, preferably shear studs, also provided for being covered with concrete can, suitably positioned, advantageously contribute to the better embedding of the steel installation component in reinforced concrete in particular when these project out of a connecting face parallel to the longitudinal orientation of the recess support or out of the top side of the recess support.

Non-positively connected to a reinforced concrete component, in particular with a reinforced concrete beam, the steel installation component forms a support construct in that it completely or partially replaces the reinforced concrete in a region in which the effect of relatively low transverse forces is preferentially provided. Here, the reinforced concrete is brought up as far as against the connecting faces in the longitudinal direction of the recess support. With a merely partial replacement of the preferentially portion-like region, the reinforced concrete runs through above and/or below the steel installation component in the longitudinal direction of the recess support over the entire length to be underpinned.

For forming the support construct, the steel installation component can be arranged in different positions relative to the reinforced concrete component. Accordingly, the top side and/or the lower side of the recess support can terminate flush with the reinforced concrete component. When the profile comprises a bearing plate, the same can terminate flush with the reinforced concrete component. If a region of the reinforced concrete component is only partially replaced, the lower side of the recess support can be supported on a reduced cross-section of the reinforced concrete component wherein it is advantageous when here the reinforcement of the reinforced concrete is continuously arranged below the steel installation component. It can likewise be advantageous when additionally or, in the case of a concrete-free lower side, only the top side of the recess support or the bearing plate of the profile lies against a reduced cross-section of the reinforced concrete component, wherein here, too, the reinforcement of the reduced cross-section is preferentially also arranged continuously.

When the steel installation component comprises an extension of the recess support on the lower side in the longitudinal direction of the same, which is preferentially configured as continuation of the steel strip beyond the plane of a connecting face, the continuation, when the lower side is supported on a reduced cross-section, can be covered with concrete. However it is also possible that the lower side of the recess support including the lower side of the continuation is kept concrete-free and the concrete is brought up as far as to the front sides of the continuation and to the connecting faces of the steel installation component.

In the following, the steel installation component and the support construct are explained in more detail by means of some exemplary embodiments and figures without the invention being restricted to these.

DETAILED DESCRIPTION

Figure 1:
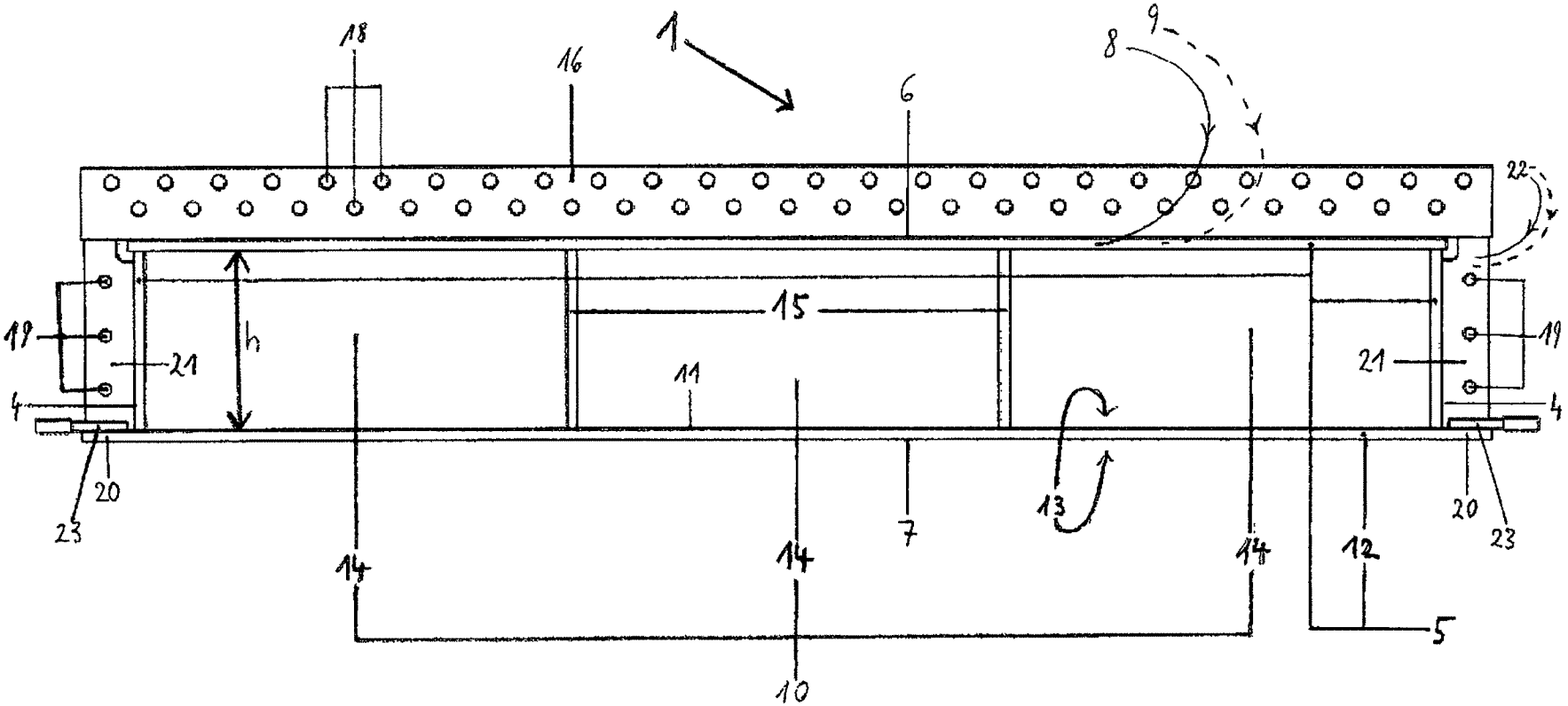
FIG. 1 shows a steel installation component in a front view.
Figure 3:
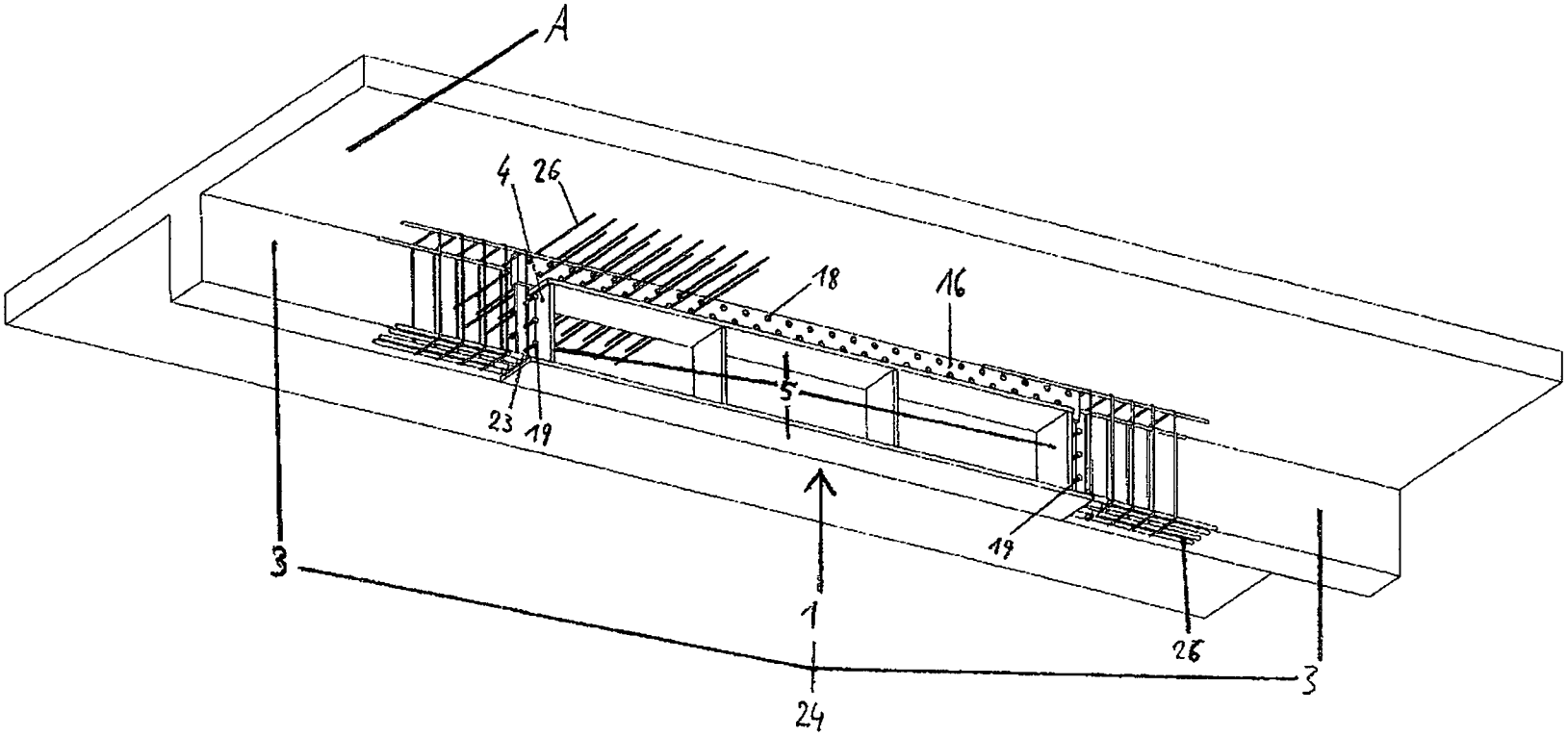
FIG. 3 shows the support construct similar to FIG. 2 obliquely from below.

FIG. 1 shows the steel installation component (1) in the front view. Here, the recess support (5) comprises on its lower side (7) a steel strip (12), which as extension (20) is run beyond the planes of the connecting faces (4). On the top side (6) of the recess support (5) a beam-like profile (16) for passing on the transverse forces is arranged, which comprises holes (18), which are provided for being penetrated by reinforcing bars (FIG. 3, Number 26). Reinforcing bar portions (23) each are welded onto the extensions (20) which, represented as a thickening of the reinforcing bar portions (23), can be connected by means of a bolted connection to the reinforcement of the reinforced concrete component (FIG. 3, Number 3). On the connecting faces (4), shear braces (21) each formed as shear plates are arranged, which with their wide sides (22) are oriented parallel to the longitudinal direction of the recess support (5) and to the shortest connecting distance between the top (6) and the lower sides (7), i.e. here parallel to the front (8) or back side (9) of the recess support (5), and are welded to the profile (16) so that the recess support (5), with the exception of its lower side (7), is enclosed frame-like. Bolts (19), here formed as shear studs, project out of the shear braces (21), out of the figure plane in the direction of the viewer. They are arranged on both sides transversely to the shear braces (21) and welded to these. Here, the recess support (5) comprises a support opening (10) which through braces (15) is subdivided into separate portions (14) and between top (6) and lower sides (7) of the recess support (5) has a height (h) that is greater than the distance of the support opening (10) to the connecting faces (4). The support opening (10) is delimited at its lower edge (11) by one of the wide sides (13) of the steel strip (12).

Figure 2:
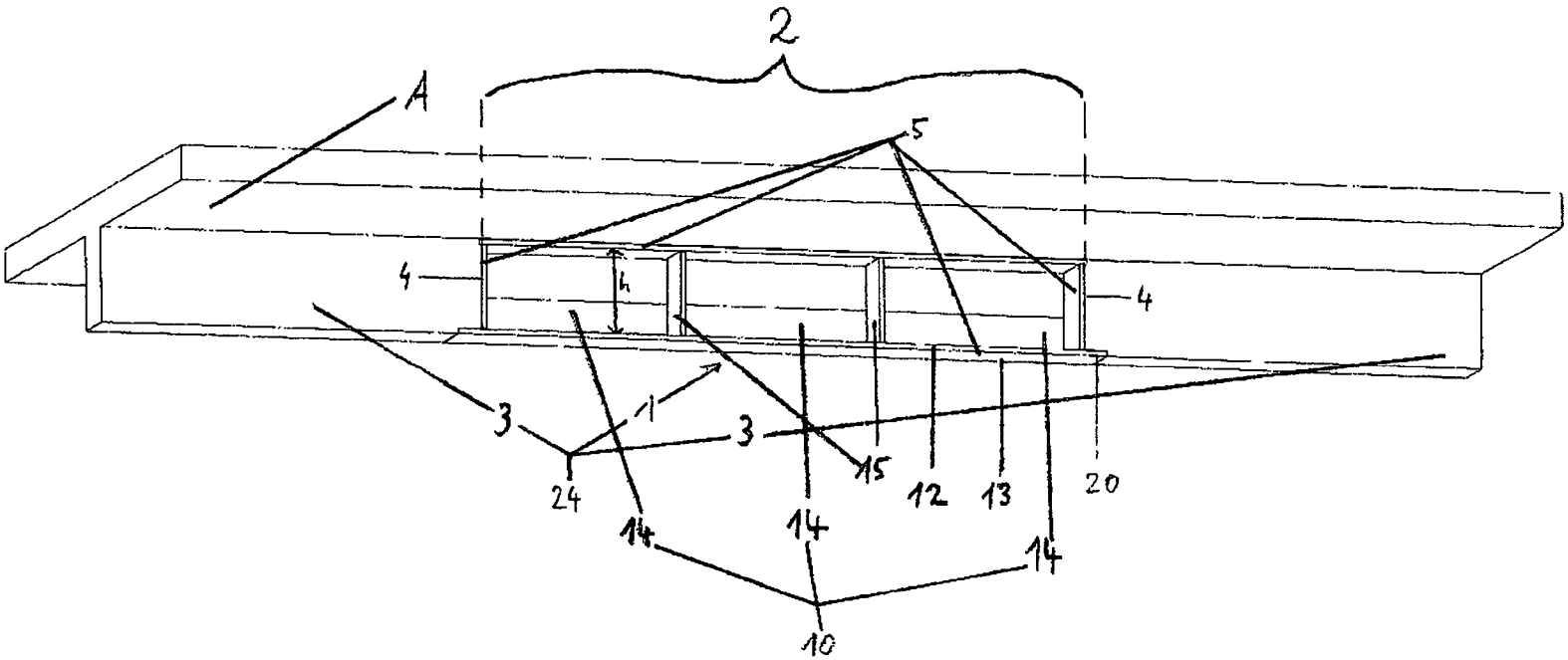
FIG. 2 shows obliquely from below a support construct of the steel installation component.

FIG. 2 shows obliquely from below the support construct (24) of the steel installation component (1) and the, here, beam-like reinforced concrete component (3) under the ceiling of a building (A). In the middle region (2) of the reinforced concrete component (3) the reinforced concrete is completely replaced by the steel installation component (1), which terminates flush with the reinforced concrete component (3) at the top and bottom. Here, the steel strip (12) of the steel installation component (1) is exposed in the region (2) of low transverse forces, to tensile forces resulting from the positive global moment and functions as a tension strip. Here, the support opening (10) is divided by two braces (15) into three portions (14). The concrete of the reinforced concrete component (3) in each case is brought up as far as to the connecting faces (4) and the front sides of the extensions (20) of the steel strip (12), whose lower wide side (13) is noticeable from below. Relative to the overall extent of the recess support (5), the support opening (10) with its portions (14) here is so large that a lot of space is available for the installation elements and at the same time comparatively little steel is installed since the distance of the support opening (10) to the connecting faces (4) is short relative to the height (h) of the support opening (10).

FIG. 3 shows the support construct (24) similar to FIG. 2 obliquely from below with the difference that the reinforced concrete component (3) and the ceiling of the building (A) are partly shown transparently so that the reinforcing bars (26) are noticeable, which are connected to the steel installation component (1) parallel to the longitudinal orientation of the recess support (5) over the reinforcing bar portions (23) and are passed through the holes (18) of the profile (16) transversely to the longitudinal orientation of the recess support (5), which profile is formed beam-like here and on its own or combined with the ceiling absorbs the local moments and forms the compression flange for the global moment.

Figure 4:
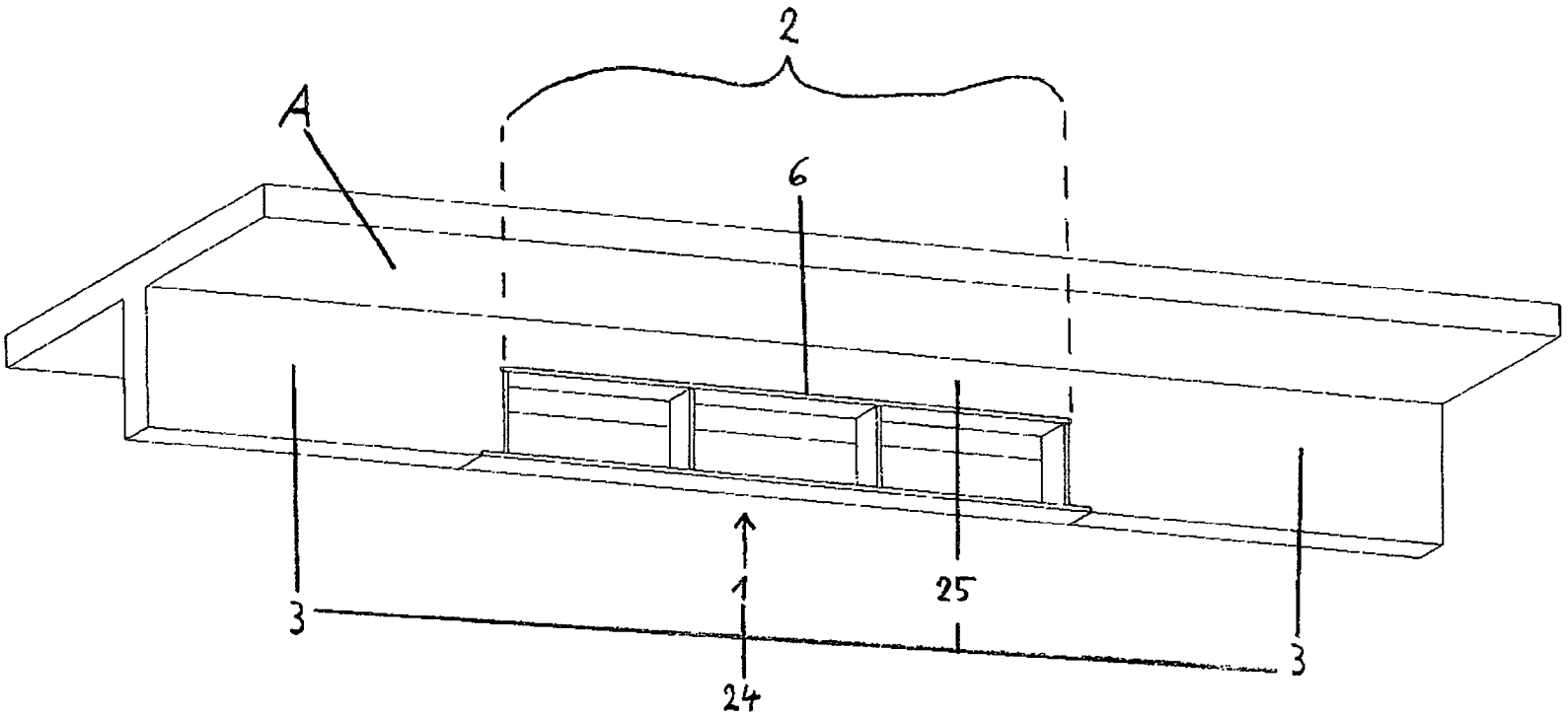
FIG. 4 shows an embodiment of the support construct below the ceiling of the building obliquely from below.

FIG. 4 shows an embodiment of the support construct (24) below the ceiling of the building (A) obliquely from below, in which the reinforced concrete component (3) in the region (2) is only in part replaced by the steel installation component (1) and the reinforced concrete component (3) above the top side (6) is configured continuously with reduced cross-section (25).

Figure 5:
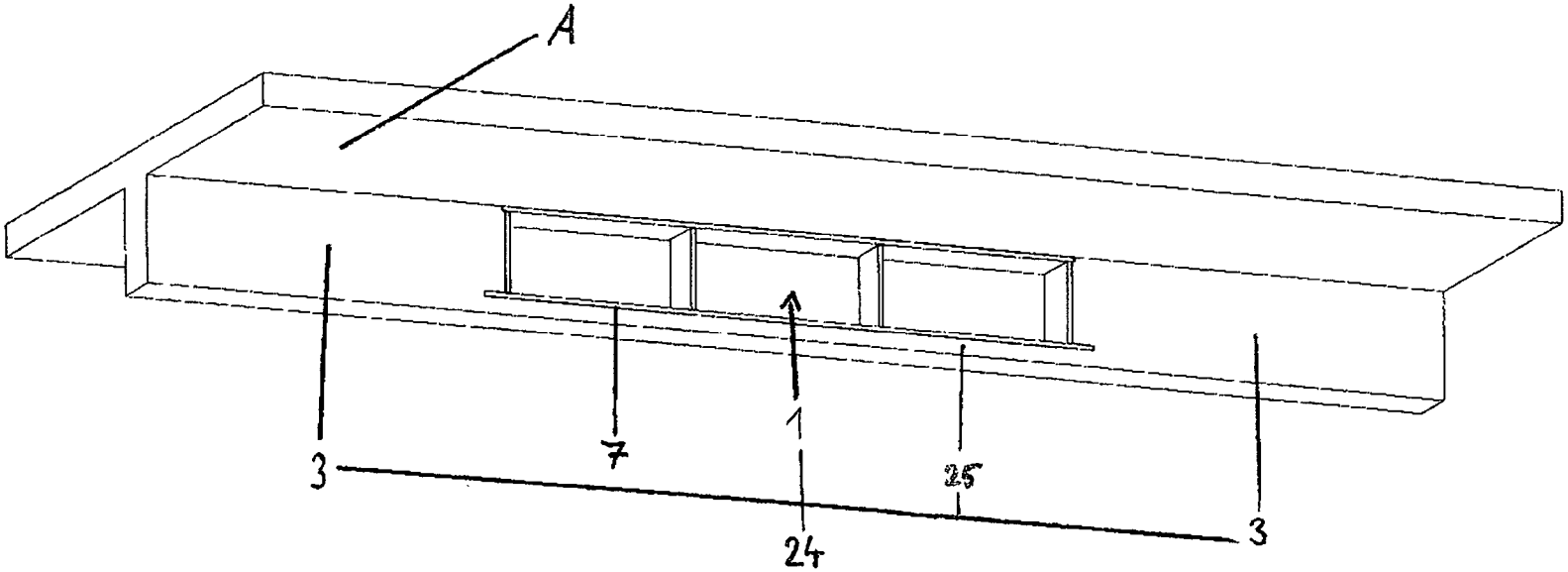
FIG. 5 shows an embodiment of the support construct below the ceiling of the building obliquely from below.

FIG. 5 shows an embodiment of the support construct (24) below the ceiling of the building (A) obliquely from below, in which the reinforced concrete component (3) in the region (2) is replaced only in part by the steel installation component (1) and the reinforced concrete component (3) below the lower side (7) is configured continuously with reduced cross-section (25).

Figure 6:
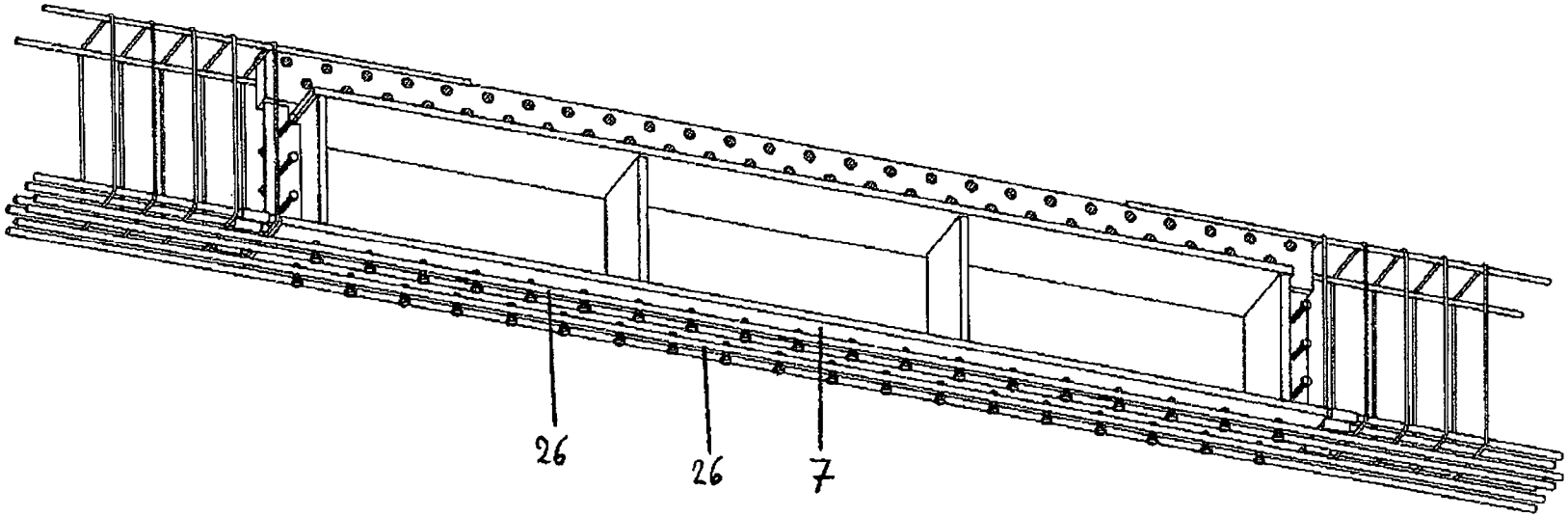
FIG. 6 shows a part of the embodiment shown in FIG. 5 without concrete.

FIG. 6 shows a part of the embodiment shown in FIG. 5 without concrete, so that the continuous reinforcing bars (26) of the reinforced concrete component (FIG. 5, Number 3) running through below the lower side (7) are visible.

Figure 7:
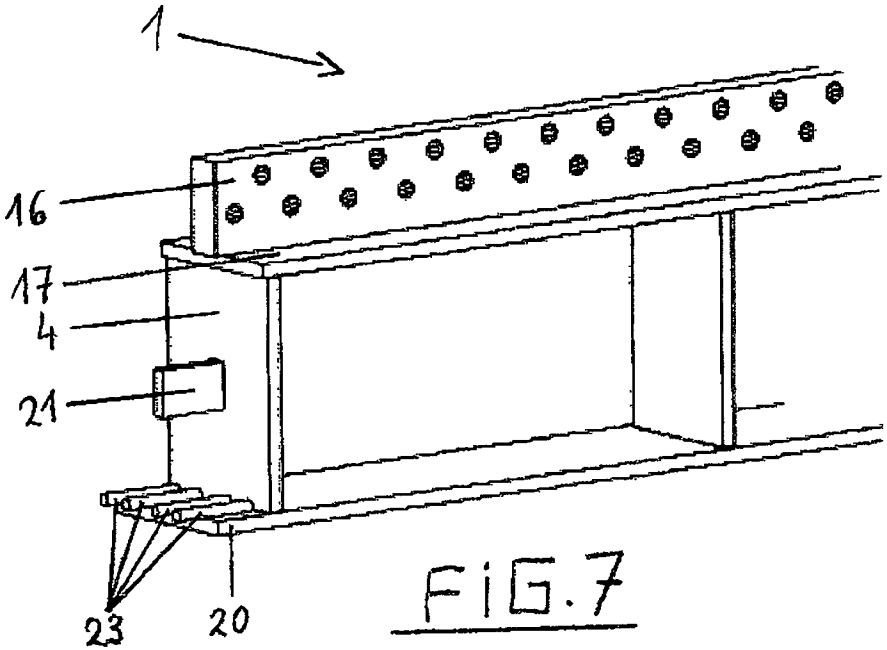
FIG. 7 shows a part of the steel installation component.

FIG. 7 shows a part of the steel installation component (1), in which the shear brace (21) is configured as a shear key. Here, the profile (16) configured beam-like is supported on the bearing plate (17). Here, the reinforcing bar portions (23) welded onto the extension (20) on the connecting face (4) are also shown.

LEGEND

1 Steel installation component
2 Predetermined region
3 Reinforced concrete component
4 Connecting face
5 Recess support
6 Top side of the recess support
7 Lower side of the recess support

8 Front side of the recess support
9 Back side of the recess support
10 Support opening
11 Edge of the support opening
12 Steel strip
13 Wide sides of the steel strip
14 Portion of the support opening
15 Bracing
16 Profile for passing on the transverse forces
17 Bearing plate
18 Holes for reinforcing bars
19 Bolts
20 Extension
21 Shear brace
22 Wide sides of the shear brace
23 Reinforcement bar portions
24 Support construct
25 Reduced cross-section of the reinforced concrete component
26 Reinforcing bars
A Building
h Height of the support opening

The invention claimed is:

1. A support construct (24), comprising
a steel installation component (1) non-positively connected to
a reinforced concrete component (25),
wherein the steel installation component (1) comprises
a profile (16) for being covered with concrete for passing on transverse forces to a top side (6) of a recess support (5), the recess support (5) comprising two connecting faces (4) spaced apart from one another in a longitudinal direction,
the top side (6), a lower side (7), a front side (8), and back side (9), each distinct from the two connecting faces (4),
a steel strip (12) having wide sides (13),
a support opening (10) leading from the front side (8) to the back side (9) for passing through installation elements, the support opening (10) being delimited by the two connecting faces (4), the top side (6), and by one of the wide sides (13) of the steel strip (12), and
a shear brace (21) for transmitting transverse forces arranged on at least one of the connecting faces (4) provided for being covered with concrete,
the shear brace (21) having wide sides (22) that are oriented parallel to the longitudinal direction of the recess support (5) and parallel to a shortest connecting distance between the top side (6) and the lower side (7), and
a bearing plate (17), to which the top side (6) belongs, which projects under the profile (16) and is provided for supporting a building (A),
wherein the steel installation component (1) completely or partly replaces the reinforced concrete component (25) in a region (2), in which an effect of relatively low transverse forces is provided and the reinforced concrete component (25) is brought up in the longitudinal direction of the recess support (5) as far as to the connecting faces (4).

2. The support construct (24) according to claim 1,
wherein the top side (6) of the recess support (5) or the bearing plate (17) of the profile (16) terminates flush with the reinforced concrete component (25).

3. The support construct (24) according to claim 1,
wherein the lower side (7) of the recess support (5) terminate flush with the reinforced concrete component (25).

4. The support construct (24) according to claim 1,
wherein the lower side (7) of the recess support (5) is supported on a reduced cross-section (26) of the reinforced concrete component (25).

5. The support construct (24) according to claim 1,
wherein the top side (6) or the recess support (5) lies against a reduced cross-section (26) of the reinforced concrete component (25).

6. The support construct (24) according to claim 4,
wherein reinforcing bars (26) of the reduced cross-section (25) are arranged continuously in the longitudinal direction of the recess support (5).

7. The support construct (24) according to claim 5,
wherein reinforcing bars (26) of the reduced cross-section are arranged continuously in the longitudinal direction of the recess support (5).

8. The support construct (24) according to claim 1,
wherein the steel strip (12) extends longitudinally beyond the two connecting faces (4).

9. The support construct (24) according to claim 1,
wherein the support opening (10) is rectangular.

10. The support construct (24) according to claim 1,
wherein the support opening (10) is subdivided into separate portions (14) by one or more braces (15) running between the top side (6) and the lower side (7),
wherein an extension of the one or more braces (15) in the longitudinal direction of the recess support (5) is shorter than a height (h) of the support opening (10).

11. The support construct (24) according to claim 1,
wherein the profile (16) is formed beam-like as T-profile or as double T-profile and arranged parallel to the longitudinal direction of the recess support (5).

12. The support construct (24) according to claim 1,
wherein the profile (16) comprises holes (18) which are provided for being penetrated by reinforcing bars (26) transversely to the longitudinal direction of the recess support (5).

13. The support construct (24) according to claim 8,
wherein the steel installation component (1), further comprises an extension (20) of the recess support (5) in the longitudinal direction on the lower side (7), which is configured as continuation of the steel strip (13) beyond a plane of a connecting face (4).

14. The support construct (24) according to claim 1,
wherein the shear brace (21) is formed as a shear plate with transversely projecting bolts (19) arranged on one or both sides with welded-on shear studs, or as shear key.

15. The support construct (24) according to claim 1,
wherein the shear brace (21) and the profile (16) are rigidly connected to one another.

16. The support construct (24) according to claim 15,
wherein the shear brace (21), the steel strip (12), and the profile (16) enclose the recess support (5).

17. The support construct (24) according to claim 1,
wherein the steel installation component (1), further comprises reinforcing bar portions (23) arranged parallel to the longitudinal orientation of the recess support (5) on at least one of the connecting faces (4) for connecting steel reinforcements of the reinforced concrete component (3).

* * * * *